US005386214A

United States Patent [19]

Sugawara

[11] Patent Number: 5,386,214

[45] Date of Patent: Jan. 31, 1995

[54] ELECTRONIC CIRCUIT DEVICE

[75] Inventor: Hideo Sugawara, Ohtawara, Japan

[73] Assignee: Fujitsu Limited, Kawasaki, Japan

[21] Appl. No.: 43,605

[22] Filed: Apr. 5, 1993

Related U.S. Application Data

[63] Continuation of Ser. No. 479,532, Feb. 13, 1990, abandoned.

[30] Foreign Application Priority Data

Feb. 14, 1989 [JP] Japan ..... 1-034677

[51] Int. Cl.[6] ..... H01Q 1/38; H01Q 13/08

[52] U.S. Cl. ..... 343/700 MS; 343/701

[58] Field of Search ..... 343/700 MS, 701, 846, 343/702; 455/280, 281; H01Q 1/38, 13/08

[56] References Cited

U.S. PATENT DOCUMENTS

| | | | |
|---|---|---|---|
| 3,707,711 | 12/1972 | Cole et al. | 343/700 MS |
| 3,778,717 | 12/1973 | Okoshi et al. | 343/700 MS |
| 4,475,108 | 1/1984 | Moser | 343/700 MS |
| 4,477,813 | 10/1984 | Weiss | 343/700 MS |
| 4,575,725 | 3/1986 | Tresselt | 343/700 MS |
| 4,736,207 | 4/1988 | Siikarla et al. | 343/700 MS |
| 4,853,703 | 8/1989 | Murakami et al. | 343/700 MS |
| 4,853,704 | 8/1989 | Diaz et al. | 343/767 |
| 4,903,033 | 2/1990 | Tsao et al. | 343/700 MS |
| 5,001,492 | 3/1991 | Shapiro et al. | 343/700 MS |

FOREIGN PATENT DOCUMENTS

| | | | |
|---|---|---|---|
| 1008825 | 3/1983 | U.S.S.R. | 343/700 MS |

*Primary Examiner*—Michael C. Wimer
*Attorney, Agent, or Firm*—Staas & Halsey

[57] ABSTRACT

An electronic circuit device comprises a printed circuit board having a first surface on which a circuit pattern is formed and on which components are mounted and a second surface on which a ground plane is formed, a coupling stub being formed in part of the ground plane and connected to the circuit pattern; and a plane antenna having an antenna element, formed on a first surface of a dielectric substrate. The printed circuit board and the plane antenna are unified such that the second surface of the printed circuit board and a second surface of the dielectric substrate are opposed to each other and the coupling stub is placed in position to be coupled to the antenna element.

6 Claims, 8 Drawing Sheets

ELECTRONIC CIRCUIT DEVICE

This application is a continuation of application Ser. No. 07/479/532, filed Feb. 13, 1990, now abandoned.

BACKGROUND OF THE INVENTION

1. Field of the Invention

The present invention relates to an electronic circuit device including a plane antenna such as microstrip patch antenna, and more particularily to an electronic circuit device which is useful where low cost is a requirement.

2. Description of the related Art

Microstrip patch antennas are widely used with mobile radio communication devices utilizing microwaves and have features of low cost and ease of manufacture, as well as low profile and high gain.

Demand is increasing for less expensive, more easily manufactured electronic circuit devices which include plane antennas such as microstrip patch antennas as described above.

FIGS. 1A and 1B illustrate an example of a prior art electronic circuit device which includes a plane antenna used as a discrete component. FIG. 1A is a perspective view and FIG. 1B is a side sectional view. In these Figures, reference numeral 1 denotes an antenna element, 2 an antenna substrate, 3 a printed circuit board, 4 a substrate of printed-circuit board 3, 5 a ground plane, 6 a circuit pattern, 7 discrete components, 8 a microwave transmitting/receiving section, 9 a feed point to the antenna element 1, and 10 a connecting pin.

In FIGS. 1A and 1B, antenna element 1 is made of a conductor and is square, the length of one side measuring about $\lambda/2$ ($\lambda$ is a wavelength used) long. It is formed on antenna substrate 2, which is made of a dielectric material, and has a contour larger than the antenna element, thereby constituting a microstrip patch antenna. With printed circuit board 3, ground plane 5 comprising a conductor covers the surface of substrate 4, which comprises of a dielectric material. Circuit pattern 6 is formed on the other side of substrate 4. Circuit pattern 6 has a circuit comprising of a microstrip line and is fixed in its prescribed positions by components 7.

Antenna substrate 2 is mounted on that portion of ground plane 5 which corresponds in position to microwave transmitting/receiving section 8 on circuit pattern 6 by bonding with antenna element 1 turned up. Feed point 9 and microwave transmitting/receiving section 8 are connected by connecting pin 10, which passes through printed-circuit board 3.

FIGS. 2A and 2B illustrate another example of the prior art electronic circuit device, which includes a plane antenna formed integrally with a case for housing an electronic circuit. FIG. 2A is a perspective view and FIG. 2B is a side sectional view. In these Figures, reference numeral 11 designates an antenna conductor plate and 12*a* package.

In FIGS. 2A and 2B, antenna conductor plate 11 is bonded to the top surface of package 12, which is formed of a dielectric material.

Printed circuit board 3, as in FIGS. 1A and 1B, is mounted on the inner surface of package 12 with circuit pattern 6 turned down. Microwave transmitting/receiving section 8 on circuit pattern 6 and feed point 9 of antenna conductor plate 11 are connected to each other by means of connecting pin 10, which passes through package 12 and printed circuit board 3.

With the prior art electronic circuit device shown in FIGS. 1A and 1B, antenna element 1 and connecting pin 10 are usually soldered together. Thus, a heat-resisting dielectric material such as glass epoxy is used for antenna substrate 2. This makes antenna substrate 2 difficult to manufacture by die molding. Moreover, holes must be bored in antenna substrate 2 and printed circuit board 3, the holes must be aligned with each other and soldering is required. This raises the manufacturing cost.

In the prior art electronic circuit device shown in FIGS. 2A and 2B, the material used for package 12 usually has no heat resistance. Thus, antenna conductor plate 11 and connecting pin 10 have to be connected beforehand by welding or soldering. This gives additional trouble and requires that antenna conductor plate 11 be made thicker. This raises the manufacturing cost.

SUMMARY OF THE INVENTION

It is an object of the present invention to provide an electronic circuit device using a plane antenna which can be manufactured easily and inexpensively.

A feature of the present invention resides in an electronic circuit device comprising a printed circuit board having a first surface on which a circuit pattern is formed on which components are mounted and a second surface on which a ground plane is formed, a coupling stub being formed in part of said ground plane and connected to said circuit pattern, a plane antenna having an antenna element, formed on one surface of a dielectric substrate, said printed circuit board and said plane antenna being unified such that the second surface of said printed circuit board and the other surface of said dielectric substrate are opposed to each other and said coupling stub is placed in position to be coupled to said antenna element.

DESCRIPTION OF THE PREFERRED EMBODIMENTS

Figure 1A:
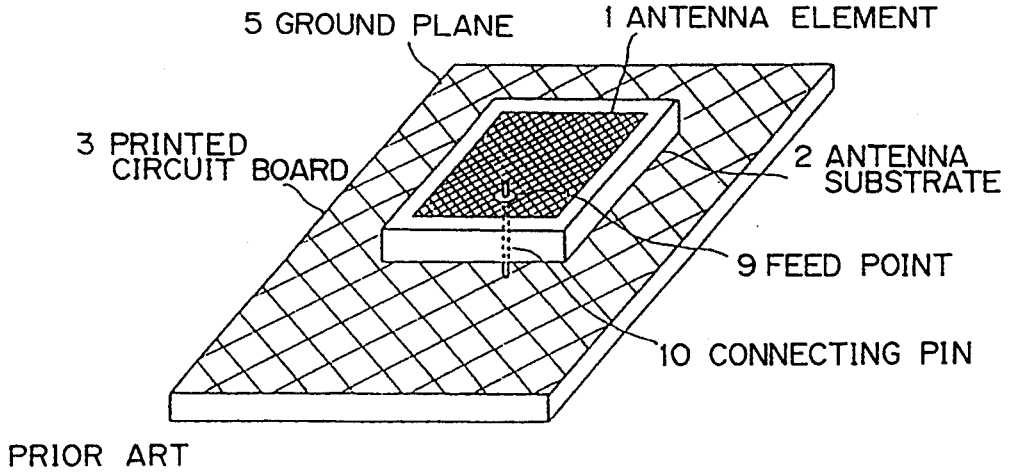
PRIOR ART Fig. 1A
FIGS. 1A and 1B are a perspective view and a side view, respectively, of a prior art electronic circuit device using a plane antenna.

As shown in embodiments of FIGS. 3A through 7B, an electronic circuit device of the present invention includes a printed-circuit board 3 and a plane antenna 14. The bottom surface of plane antenna 14 is unified to the top surface of printed-circuit board 3. These surfaces have no antenna element opposed to each other, and at least one coupling stub 15, 18 or 20 is placed in position to be coupled to antenna element 1.

Printed-circuit board 3 has circuit pattern 6 formed on its bottom surface and ground plane 5 formed on its top surface. Various components are mounted on circuit pattern 6. Part of ground plane 5 forms at least one coupling stub 15, 18 or 20 which is connected to circuit pattern 6.

Circuit pattern 6 is formed on the bottom surface of printed circuit board 3 and components 7 are mounted on circuit pattern 6. Ground plane 5 covers the top surface, or the reverse side of printed circuit board 3. Coupling stubs 15, 18 or 20, connected with microwave transmitting/receiving section 8 on circuit pattern 6, are formed on part of ground plane 5.

Plane antenna 14 has antenna element 1 formed on antenna substrate 2 or package 12 which are made of a dielectric material. The bottom surface of plane antenna 14 is bonded to the top surface of printed circuit board 3. These surfaces have no antenna element opposed to each other, and coupling stub 15, 18 or 20 is placed in position to be coupled to antenna element 1.

Microwave transmitting/receiving section 8 on circuit pattern 6 of printed circuit board 3 and antenna element 1 are thereby coupled to each other through coupling stub 15, 18 or 20 for transmission of microwave power therebetween. Thus, a microwave can be transmitted from printed circuit board 3 via antenna element 1 or received by printed circuit board 3 through antenna element 1.

In the electronic circuit device of the present invention, antenna element 1 is not directly connected to printed circuit board 3. This obviates the need for welding or soldering of antenna element 1. Thus, the antenna itself can be manufactured inexpensively and the number of manufacturing processes reduced.

Figure 3A:
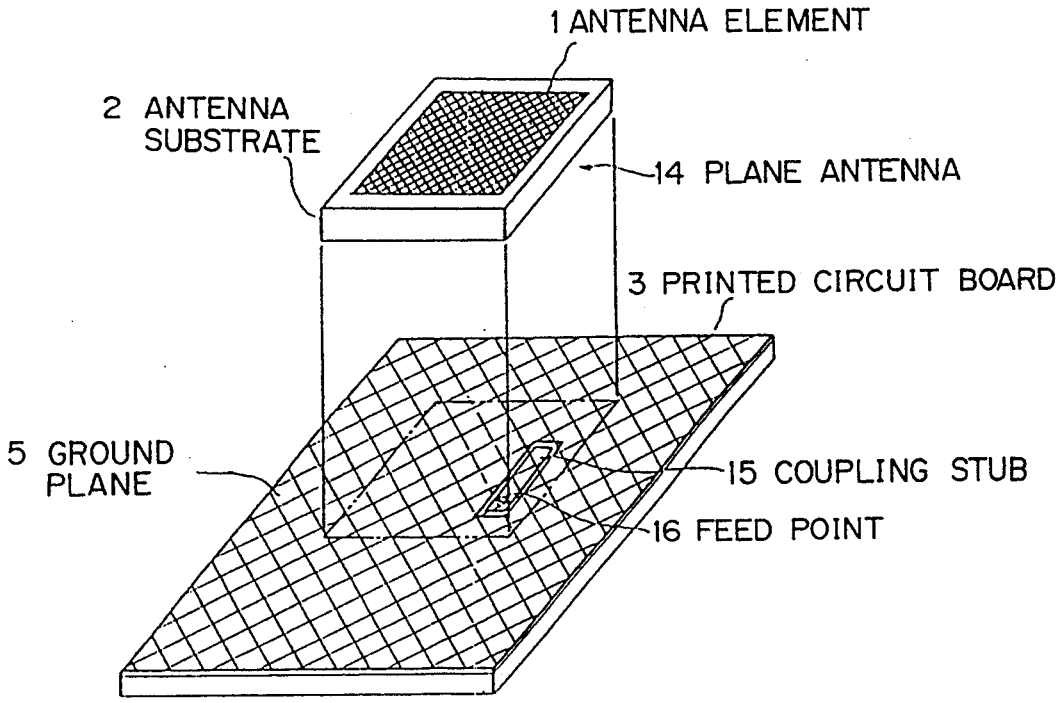
FIGS. 3A and 3B are a perspective view and a side sectional view, respectively, of an embodiment of the present invention.
Figure 3B:
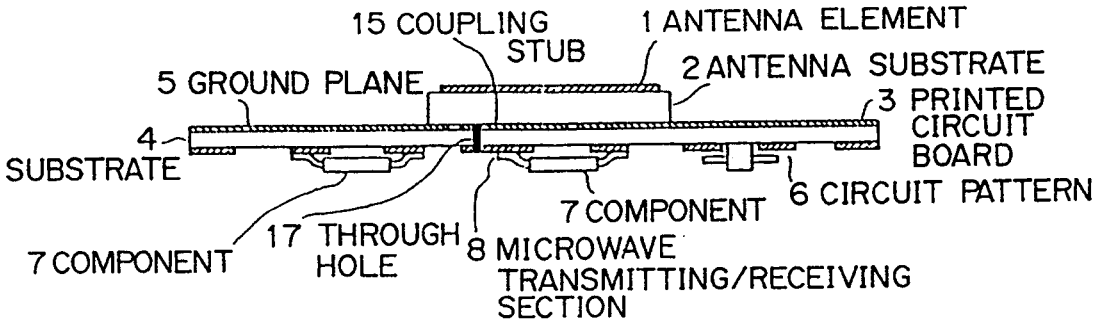

FIGS. 3A and 3B show an exploded perspective view and a side sectional view, respectively, of an electronic circuit device according to a first embodiment of the present invention. Like reference numerals are used to designate parts or components corresponding to those in FIGS. 1A and 1B. Reference numeral 15 designates a coupling stub, 16 a feed point of coupling stub 15, and 17 a through hole adapted to connect feed point 16 to microwave transmitting/receiving section 8.

In FIGS. 3A and 3B, antenna element 1 is made of a conductor and is square or rectangular, the length of one side measuring about $\lambda/2$. The antenna element comprises a thin metal film formed on the antenna substrate 2 by deposition or plating and having a somewhat larger contour than antenna element Alternatively, antenna element 1 may be fabricated by bonding a metallic foil to antenna substrate 2 with adhesive tape or attaching a conductor plate to the antenna substrate by suitable means. Antenna pattern 1 and antenna substrate 2 constitutes a microstrip patch plane antenna 14.

Printed circuit board 3 is formed, for example, of a glass epoxy plate covered with copper. Ground pattern 5 is formed to cover the whole surface of substrate 4, which consists of an insulating material, and circuit pattern 6 is formed on the reverse side of substrate 4. A microstripline circuit is formed on circuit pattern 6, and components 7 are mounted in positions to form a desired circuit. Part of ground plane 5 is cut out to form coupling stub 15. Feed point 16 of coupling stub 15 and microwave transmitting/receiving section 8 on printed circuit beard 3 are connected to each other by means of through hole 17. Antenna substrate 2 is attached, for example, by bonding, to that portion of ground plane 5 where coupling stub 15 is provided, with coupling stub 15 oriented parallel to one side of antenna element and antenna element 1 turned up.

Coupling stub 15 forms a quarter-wavelength ($\lambda/4$) open-end stub. By being connected to microwave transmitting/receiving section 8, coupling stub 15 is coupled to antenna element 1 to provide a feed mode in which a node is produced in the center of antenna element 1 in the direction orthogonal to coupling stub 15. Thus, microwave power is transmitted between microwave transmitting/receiving section 8 and antenna element 1 so that the microwave is transmitted or received through antenna element 1.

Figure 4A:
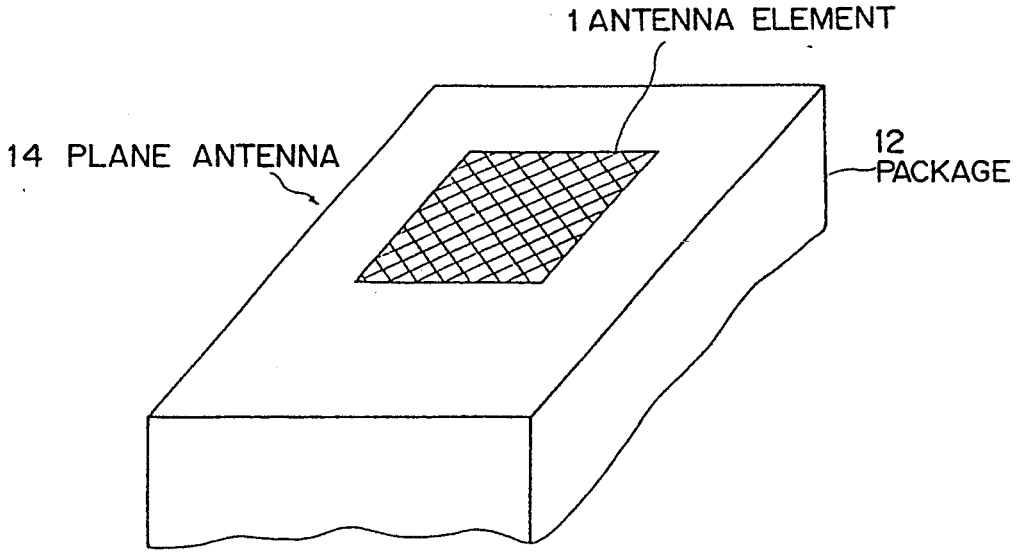
FIGS. 4A and 4B are a perspective view and a side sectional view, respectively, of another embodiment of the present invention.
Figure 4B:
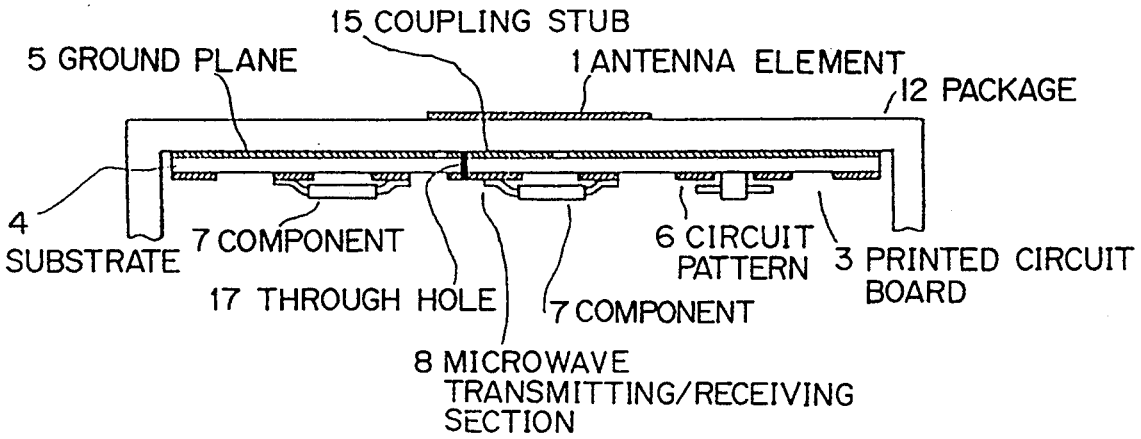

FIGS. 4A and 4B are a perspective view and a side sectional view, respectively, of a second embodiment of the present invention in which like reference numerals are used to designate parts corresponding to those in FIGS. 3A and 3B.

In FIGS. 4A and 4B, antenna element 1 is provided on the top surface of dielectric package 12, which is formed integrally with the antenna substrate, as in the embodiment of FIGS. 1A and lb. In this case as well, antenna element 1 and package 12 forms plane antenna 14.

Figure 1B:
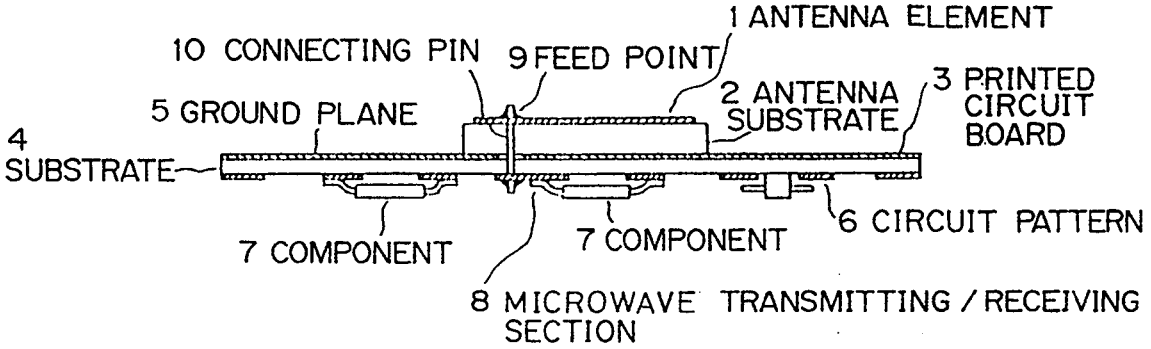
PRIOR ART Fig. 1B
Figure 2A:
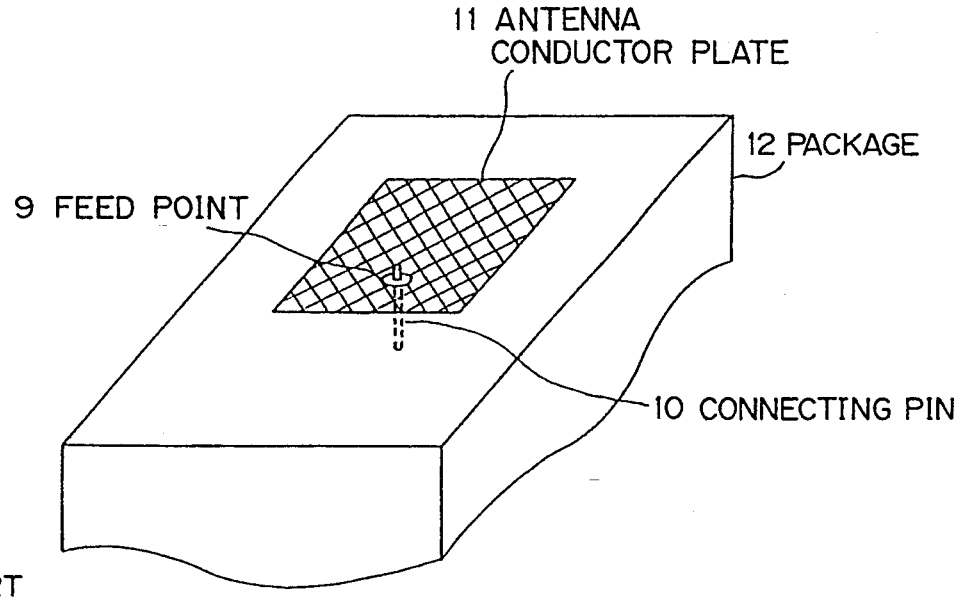
PRIOR ART Fig. 2A
FIGS. 2A and 2B are a perspective view and a side sectional view, respectively, of another prior art electronic circuit device using a plane antenna.
Figure 2B:
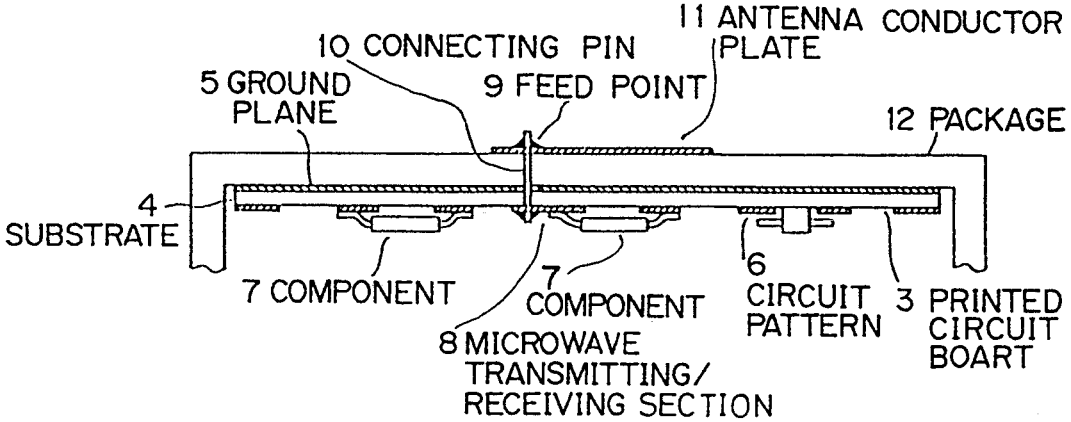
PRIOR ART Fig. 2B

To the inner surface of package 12 is attached printed circuit board 3, as in the first embodiment of FIGS. 1A and 1B, with circuit pattern 6 turned down. Antenna element 1 is formed on that portion of the top surface of package 12 which corresponds to coupling stub 15 in printed circuit board 3.

In this embodiment as well, coupling stub 15 forms a quarter-wavelength ($\lambda/4$) open-end stub. By being connected to microwave transmitting/receiving section 8, coupling stub 15 is coupled to antenna element 1 so that microwave power is transmitted between microwave transmitting/receiving section 8 and antenna element 1, thus transmitting or receiving a microwave from antenna element 1.

Figure 5:
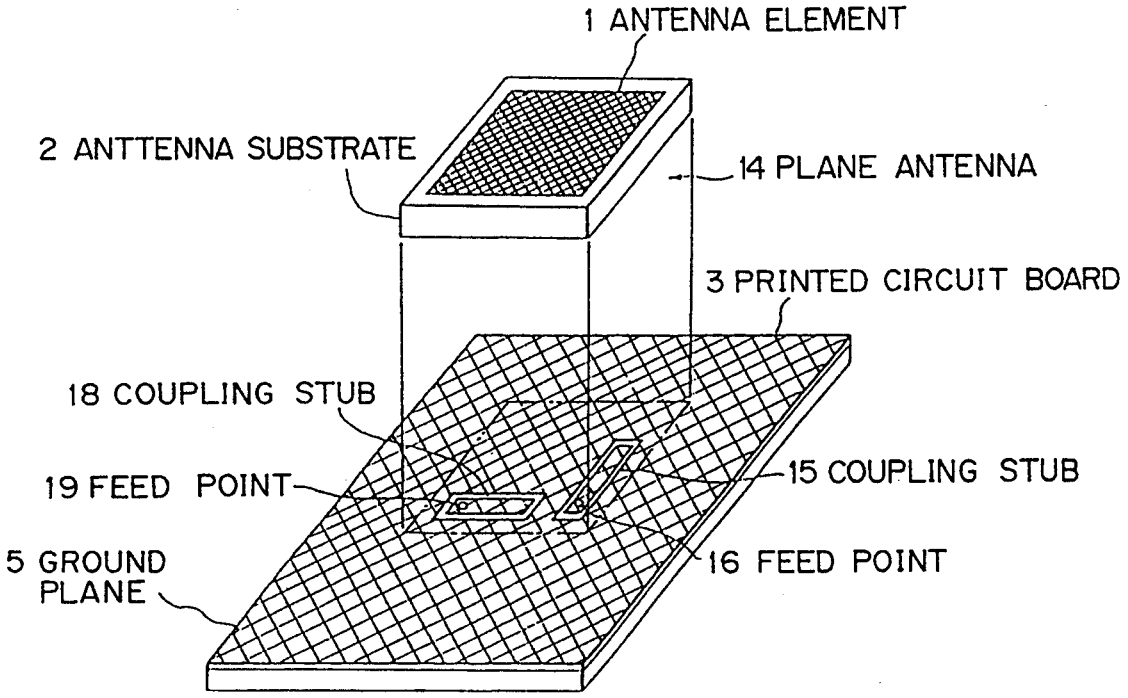
FIG. 5 is a perspective view of still another embodiment of the present invention.

FIG. 5 is an exploded perspective view of a third embodiment of the present invention in which like reference numerals are used to designate parts corresponding to those in FIGS. 3A and 3B. Reference numeral 18 designates a coupling stub and 19 a feed point of coupling point 18.

Coupling stubs 15 and 18 are formed parallel to two adjoining sides of antenna element 1 with their feed points 16 and 19 connected by means of through holes to microwave transmitting/receiving section 8 on the printed circuit board. When coupling stubs 15 and 18 are fed in parallel and in phase, a feed mode is produced in which a node is produced along a diagonal line of antenna element 1. However, when coupling stubs 15 and 18 are fed in phase quadrature through a phase shifting means, a circularly polarized wave feed mode results.

Figure 6:
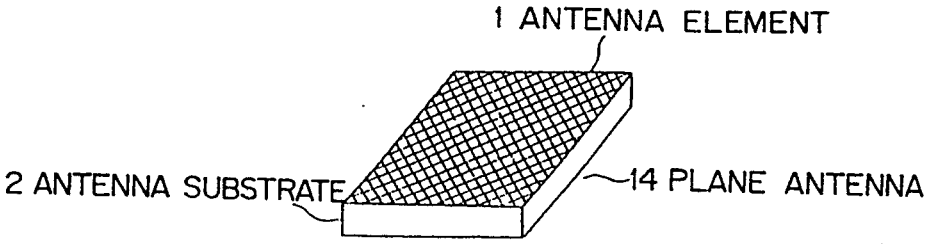
FIGS. 6 is a perspective view of a further embodiment of the present invention.

FIG. 6 is a perspective view of a fourth embodiment of the present invention. This embodiment is distinct from the above embodiments in that antenna element 1 covers the surface of antenna substrate 2.

According to the embodiment of FIG. 6, antenna element 1 and antenna substrate 2 can be easily manufactured by cutting a dielectric plate having its whole surface covered with a conductor foil.

Figure 7A:
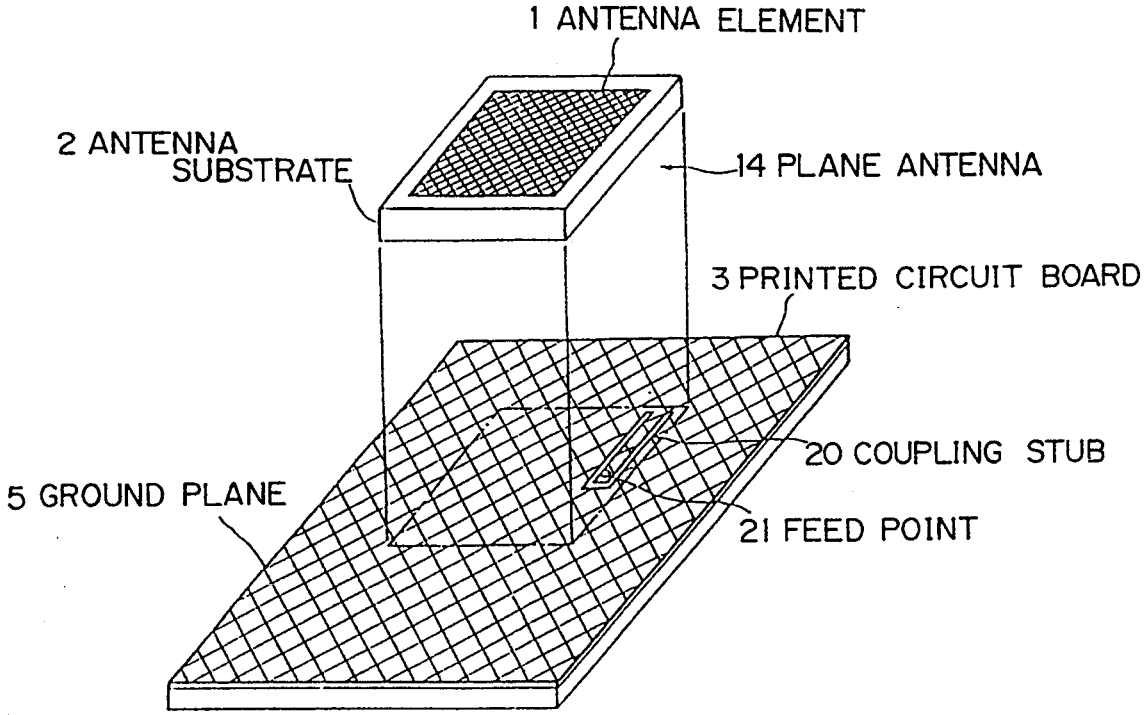
FIGS. 7A and 7B are a perspective view and a side sectional view, respectively, of a still further embodiment of the present invention.
Figure 7B:
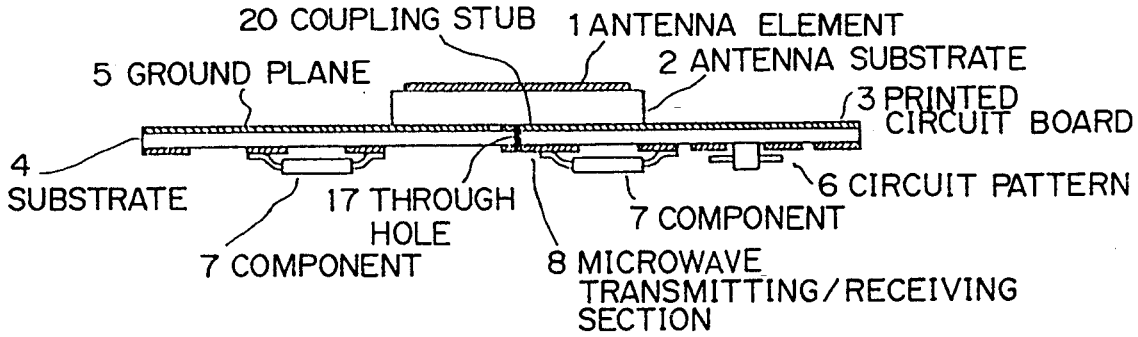

FIGS. 7A and 7B are an exploded view and a side sectional view, respectively, of a fifth embodiment of the present invention. In the Figures, like reference numerals are used to designate parts corresponding to those in FIGS. 3A and 3B. Reference numeral 20 designates a coupling stub and 21 a feed point.

In the embodiment of FIGS. 7A and 7B, coupling stub 20 is formed by clipping ground plane 5 to form a quarter-wavelength ($\lambda/4$) shorted stub. As in the embodiment of FIGS. 3A and 3B, by connecting feed point 21 to microwave transmitting/receiving section 8, coupling stub 20 is coupled to antenna element 1 to provide a feed mode which is produced in the center of antenna element 1 in the direction orthogonal to coupling stub 20. Thus, microwave power is transmitted between microwave transmitting/receiving section 8 and antenna element 1, so that the microwave is transmitted to or received from antenna element 1.

The microwave transmitting/receiving section connected to the coupling stub will next be described in detail.

Figure 8:
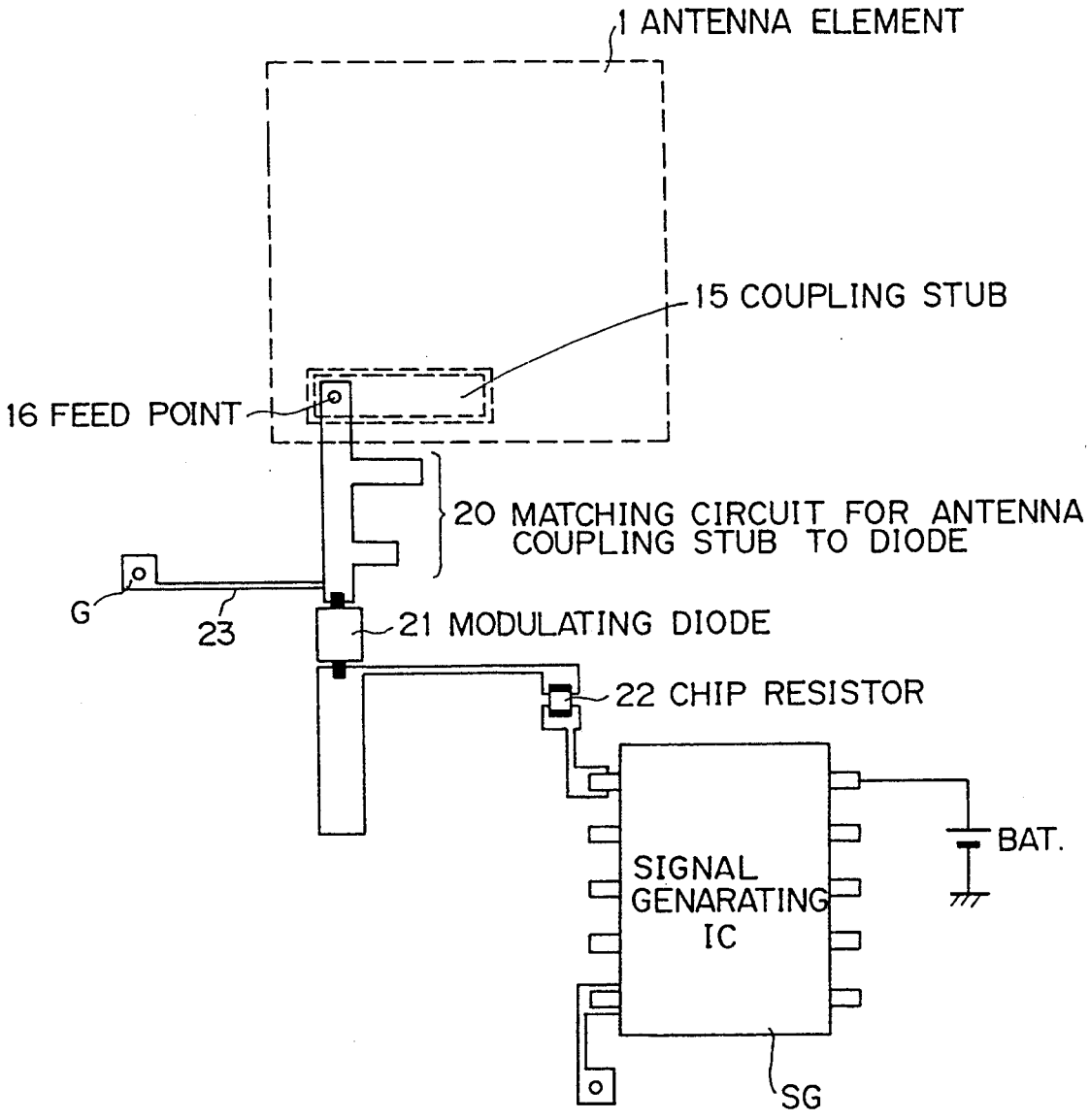
FIG. 8 illustrates a circuit arrangement of the embodiment.
Figure 9:
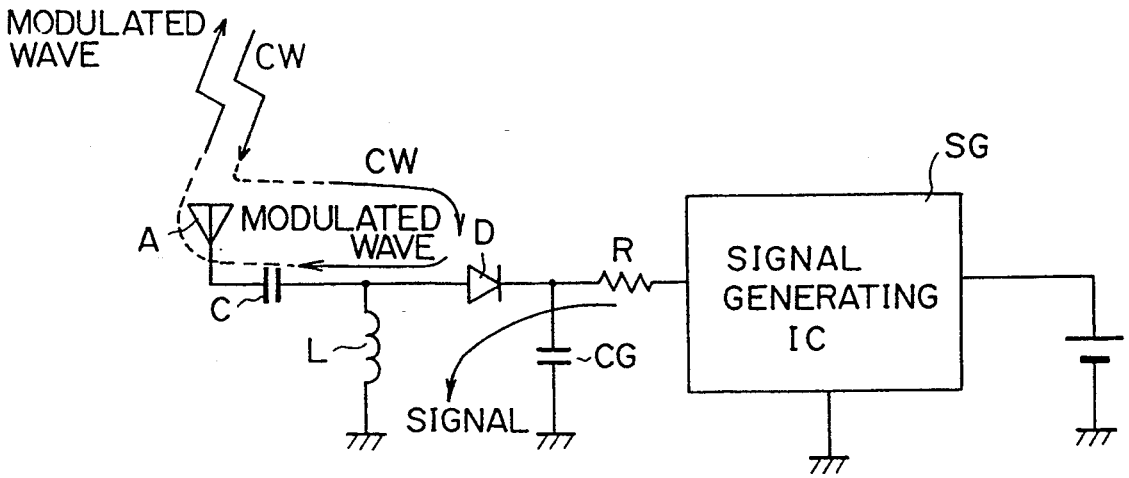
FIG. 9 is an equivalent circuit diagram of the embodiment shown in FIG. 8.

FIG. 8 is a schematic diagram of the microwave transmitting/receiving circuit and FIG. 9 is its equivalent circuit diagram. In FIG. 8, coupling stub 15 is formed parallel to one side of antenna element 1 and a matching circuit 20 is connected to an end of coupling stub 15. As described above, antenna element 1 and coupling stub 15 are coupled to each other via dielectric antenna substrate 2. Coupling stub 15 is provided on the side of printed circuit board 3 opposite to the side on which matching circuit 20, modulating diode 21 and chip resistor 22 are mounted. Coupling stub 15 and matching circuit 20 are connected to each other by a through hole at feed point 16. In FIG. 8, the solid lines represent components mounted on printed circuit board 3. To avoid coupling with other circuits, coupling stub 15 is provided in a position where no components are mounted.

The matching circuit connected to coupling stub 15 is adapted to match modulating diode 21, to be described later, with the coupling stub. The other end of the matching circuit is connected to the anode of modulating diode 21 and a bias circuit 23 which connects the anode of the diode to ground. Bias circuit 23 is formed of a line having a characteristic impedance which is much higher than that of the microstrip line, e.g., the characteristic impedance of matching circuit 20, and has a length of about quarter the wavelength used ($\lambda/4$). This will provide a high impedance for signals within a microwave frequency band in use. In the equivalent circuit of FIG. 9, matching circuit 20 and coupling stub 15 are represented together by a coupling capacitor C and bias circuit 23 is represented by a biasing (grounding) coil L.

The cathode of modulating diode 21 is connected to a line having a low characteristic impedance and a length of about $\lambda/4$. This line serves to connect the cathode of modulating diode 21 to ground for signals within the frequency band used and is represented by a capacitor CG in the equivalent circuit of FIG. 9. Modulating diode D is equivalently connected to antenna A under a matched condition and its cathode is connected to ground.

On the other hand, the cathode of modulating diode D is connected to a signal generating integrated circuit (IC) SG via a resistor R. Signal generating integrated circuit SG generates a code signal to be transmitted. Each electronic circuit device is allocated a separate code beforehand.

The embodiment of FIG. 8 is adapted to generate a signal representing a number of parts which are moving on a belt conveyer in a factory. For this reason, serial data, such as a code generated by signal generating integrated circuit SG, is applied to the cathode of modulating diode D. Modulating diode D is a variable capacitance diode whose capacitance varies with the code output from signal generating integrated circuit SG.

In the embodiment of FIG. 8, an unmodulated wave (CW) is generated by a fixed station, which is received by antenna 1 and then applied to modulating diode D via matching circuit 20. Thus, the unmodulated wave is phase modulated with variation in diode capacitance. The phase modulated wave is transmitted in the opposite direction to the input unmodulated wave CW and is then outputted from antenna A.

Though not shown, the fixed station includes an oscillator for generating an unmodulated wave and a homodyne detector. That is, the fixed station detects the modulated wave produced by modulating diode 21 and transmitted from antenna A to recover a signal (code) generated by signal generating integrated circuit SG.

By this operation, the unmodulated wave CW generated by the fixed station is received and modulated, and the modulated wave is returned to the fixed station.

In the embodiment of the present invention, each mobile station is provided with the circuit of FIG. 8 and the code generated by signal generating integrated circuit SG varies from mobile station to mobile station. Thus, when a mobile station enters an area where an unmodulated wave generated by a fixed station can be received and a modulated wave can be returned to the fixed station, the type of mobile station can be clearly identified by the fixed station. For example, where various types of parts are moving on a belt conveyer, if each type of part is assigned a separate code by signal generating integrated circuit SG, then the types of moving parts can be identified. In addition, in the present invention, since a received signal is modulated and then returned, there is no need for an oscillator to generate a microwave signal. It is only required to drive signal generating integrated circuit SG, thus making battery drive possible as shown in FIG. 8.

As described above, according to the present invention, the antenna element and the microwave transmitting/receiving section are not directly connected to each other and the microwave is transmitted through the coupling stub. Therefore, there is no need for welding or soldering for connecting the antenna element and the antenna element need not be made thicker, thus decreasing the number of manufacturing processes and the material cost. The present invention may also be applied to other plane antennas in addition to the microstrip patch antenna described above.

What is claimed is:

1. The electronic circuit device comprising:

a printed circuit board having a first surface on which a circuit pattern is formed and a second surface on which a ground plane is formed, a coupling stub being formed in a plane of said ground plane, said coupling stub being electrically isolated from said ground plane and electrically connected to said circuit pattern by an electrical conductor extending through said printed circuit board, and components including a modulating element mounted on said first surface of said printed circuit board and electrically connected to said circuit pattern;

a plane antenna having an antenna element, formed on a first surface of a dielectric substrate, said printed circuit board and said plane antenna being attached to each other such that the second surface of said printed circuit board and a second surface of said dielectric substrate are juxtaposed to each other and said coupling stub is electromagnetically coupled to said antenna element; and signal modulating means for producing a modulated signal by modulating a non-modulated signal received by said antenna element, said non-modulated signal being electromagnetically coupled from said antenna element to said coupling stub and inputted from said coupling stub to said modulating element, said modulated signal being outputted from said modulating element to said coupling stub and electromagnetically coupled from said coupling stub to said antenna element, said signal modulating means includes means for changing a capacitance of said modulating element and a signal generating integrated circuit driven by a battery, said modulating element being operatively connected to said signal generating integrated circuit so as to receive a code output from said signal generating integrated circuit and to modulate said non-modulated signal according to said code output.

2. The electronic circuit device according to claim 1, in which said antenna element has a square shape having sides which measure about one-half of the wavelength of the service frequency.

3. The electronic circuit device according to claim 1, in which said antenna element has a rectangular shape having one side which measures about one-half of the wavelength of the service frequency.

4. The electronic circuit device according to claim 2, in which said coupling stub is an open-end stub provided parallel to one side of said antenna element and having a length of about a quarter of the wavelength of the service frequency.

5. The electronic circuit device according to claim 2, further comprising a second coupling stub, said coupling stub and said second coupling stub being provided parallel to two adjoining sides of said antenna element.

6. An electronic circuit device comprising:

a printed circuit board having a first surface on which a circuit pattern is formed and a second surface on which a ground plane is formed, a coupling stub being formed in a plane of said ground plane, said coupling stub being electrically connected at one end to said ground plane and electrically connected to said circuit pattern by an electrical conductor extending through said printed circuit board, and components including a modulating element mounted on said first surface of said printed circuit board and electrically connected to said circuit pattern;

a plane antenna having an antenna element, formed on a first surface of a dielectric substrate, said printed circuit board and said plane antenna being attached to each other such that the second surface of said printed circuit board and a second surface of said dielectric substrate are juxtaposed to each other and said coupling stub is electromagnetically coupled to said antenna element, and said coupling stub being a shortened stub provided parallel to one side of said antenna element and having a length of about a quarter of a wavelength of the service frequency; and signal modulating means for producing a modulated signal by modulating a non-modulated signal received by said antenna element, said non-modulated signal being electromagnetically coupled from said antenna element to said coupling stub and inputted from said coupling stub to said modulating element, said modulated signal being outputted from said modulating element to said coupling stub and electromagnetically coupled from said coupling stub to said antenna element, said signal modulating means including means for changing a capacitance of said modulating element and a signal generating integrated circuit driven by a battery, said modulating element being operatively connected to said signal generating integrated circuit so as to receive a code output from said signal generating integrated circuit and to modulate said non-modulated signal according to said code output.

* * * * *

UNITED STATES PATENT AND TRADEMARK OFFICE

CERTIFICATE OF CORRECTION

PATENT NO. : 5,386,214

DATED : January 31, 1995

INVENTOR(S) : Sugawara

It is certified that error appears in the above-indentified patent and that said Letters Patent is hereby corrected as shown below:

Column 1, line 14, delete "related" and insert --Related--.

Column 2, line 55, delete "FIGS." and insert --FIG.--.

Column 3, line 55, after "element" insert --1.--.

Column 4, line 3, delete "beard" and insert --board-- line 7, after "element" insert --1-- line 27, delete "1b" and insert --1B--

Column 5, line 49, after "about" insert --a--.

Signed and Sealed this

Sixth Day of June, 1995

*Attest:*

Bruce Lehman

BRUCE LEHMAN

*Attesting Officer*

*Commissioner of Patents and Trademarks*